United States Patent [19]

George, II

[11] Patent Number: 4,993,478

[45] Date of Patent: Feb. 19, 1991

[54] UNIFORMLY-COOLED CASTING WHEEL

[75] Inventor: Paul E. George, II, Dublin, Ohio

[73] Assignee: Battelle Development Corporation, Columbus, Ohio

[21] Appl. No.: 494,648

[22] Filed: Mar. 16, 1990

[51] Int. Cl.[5] ..... B22D 11/06; B22D 11/124

[52] U.S. Cl. ..... 164/479; 164/429; 164/443; 164/485

[58] Field of Search ..... 164/429, 423, 443, 463, 164/479, 485

[56] References Cited

FOREIGN PATENT DOCUMENTS 3839110 6/1989 Fed. Rep. of Germany ..... 164/443
59-66954 4/1984 Japan ..... 164/429

*Primary Examiner*—Kuang Y. Lin
*Attorney, Agent, or Firm*—Barry S. Bissell

[57] ABSTRACT

Metal strip 9 cast directly from the melt onto a cylindrical casting drum 20 is made more uniform in thickness and in structure by making the temperature of the casting surface and, therefore, heat transfer more uniform, thus reducing distortion of the casting surface. This is accomplished by a novel arrangement of helical coolant channels 25 extending below the casting surface 10 and in heat transfer relationship with the casting surface and being at an angle of between about 15° and 75° (and preferably between about 45° and 75°) to the drum axis. At least one coolant inlet 21 and one coolant outlet 22 supply and withdraw coolant to each channel. In one embodiment, inlets (21*a*, 21*b*) are alternated on the same side of the shell with outlets (22*a* and 22*b*) of adjacent channels so that the cooler regions around inlets and alternated with higher temperature outlet regions to balance the temperature around the surface.

23 Claims, 3 Drawing Sheets

SECTION A-A

UNIFORMLY-COOLED CASTING WHEEL

TECHNICAL FIELD OF THE INVENTION

The invention relates to casting of metal products, particularly strip material, from a molten mass of the metal, such as shown in U.S. Pat. No. 4,865,117 (which is incorporated herein by reference). Typically, a chilled casting drum or wheel is utilized to cast and solidify the strip. A thin layer of molten metal is introduced onto the chill surface and the latent heat of the melt flows radially into the wheel, causing solidification. The thickness of the strip as well as the microstructure are highly dependent on the cooling rate of the melt. Higher rates of heat transfer to the chill surface occur when the strip is in close intimate contact (adheres) with the surface. A greater amount of heat can be transferred during this time so that thicker, more uniform strip can be produced.

When the melt solidifies, it adheres (mechanically bonds) for a short time and is then released from the drum surface. We have demonstrated that the stresses induced by the thermal contraction of the solidifying metal causes the bond to rupture. A non-uniform temperature across the casting substrate will cause non-uniform heat transfer from the solidifying metal to the casting wheel which produces non-uniform stresses and non-uniform bond rupture in localized areas. These factors may cause non-uniform thickness and non-uniform growth of the microstructure in the strip.

A non-uniform temperature across and around the casting wheel will also result in thermal distortion of the casting wheel, again potentially leading to a non-uniform cast product. The uniformity of the cast strip and the thermal distortion of the casting wheel are both dependent on the configuration of coolant flow and the local coolant temperature in the wheel. Some inventions have been made in this area with circumferential channels (U.S. Pat. No. 4,842,040), but such apparatus needs internal supply and return plenums under the casting surface which produces non-uniform thermal gradients around the casting surfaces.

SUMMARY OF THE INVENTION

The invention comprises a liquid-cooled substrate for casting uniform metal products directly from the melt including a cylindrical casting drum or wheel having an outer circumferential casting surface and a plurality of helical coolant channels extending below the casting surface and in heat transfer relationship with the casting surface and being substantially parallel to each other at an angle of between about 15° and 75° (and preferably between about 45° and 75°) to the drum axis. The invention further includes means for circulating a coolant liquid through the coolant channels in either the same direction or in opposite directions in adjacent channels, each of which have distinct advantages.

In one embodiment, the casting channels may extend from near one side to near the other side, wherein each coolant channel communicates with an inlet near one side of the substrate and an outlet near the other side. In the case when coolant flow is in opposite directions in adjacent channels, the inlet of each coolant channel is closer to the outlet than it is to the inlet of each adjacent coolant channel. In this embodiment, the coolant source and coolant dump may be reservoirs located around the axle on both sides of the drum. In the case when coolant flow is in the same direction in adjacent channels, the inlets of all coolant channels are all on one side of the drum and all the outlets are on the other side. In this embodiment, the coolant source and coolant dump may be reservoirs located around the axle on opposite sides of the drum.

In another embodiment, the casting channels may still extend from near one side to near the other side, but the inlets and outlets are all on one side of the casting surface, and coolant flow is in opposite directions in adjacent channels. Adjacent coolant channel pairs are joined in liquid communication on the one side of the casting surface and the coolant liquid is circulated in through a coolant inlet in the first coolant channel near one side of the casting surface and out through a coolant outlet in the second coolant channel near the same side of the casting surface. In this embodiment, the coolant source and coolant dump may be reservoirs located only on one side of the core.

In either embodiment, the substrate may comprise a cylindrical core body and a separate annular casting shell which fits over the core body. The coolant channels may then comprise machined grooves in the casting shell enclosed by the outer surface of the core body or machined grooves in the outer surface of the core body enclosed by the inside surface of the casting shell.

The invention also includes a process for casting uniform metal products directly from a metal melt by extracting a molten metal layer from an open tundish on an outer cylindrical casting surface of a cylindrical substrate and solidifying the molten metal layer to a solid strip including circulating a coolant liquid through a plurality of adjacent helical coolant channels extending under the casting surface substantially parallel to each other at an angle of between about 15° and 75° (and preferably between 45° and 75°) to the drum axis. The coolant flow may be either in the same direction or in opposite directions in adjacent channels.

DESCRIPTION OF THE PREFERRED EMBODIMENTS

The invention comprises apparatus for casting of metal products from the melt. It comprises apparatus for uniformly cooling the casting surface and is, therefore, particularly useful for casting wide strip material. The thickness and microstructure of strip are particularly dependent on the substrate temperature. Any non-uniformity in temperature across the casting surface will lead to non-uniform heat transfer which imposes thickness and structural variation in the cast strip. Since one of the primary objects of direct cast strip is to cast net-shape and near-net-shape products, the non-uniformity is to be avoided. Non-uniform temperature can also cause differential expansion of the casting surface leading to a distortion of the casting wheel and periodic undulation in the surface. These undulations disrupt the casting mechanics and cause non-uniform thickness in the cast products, especially when a second roller is used in the process to contact and smooth the upper surface of the cast product.

Figure 1:
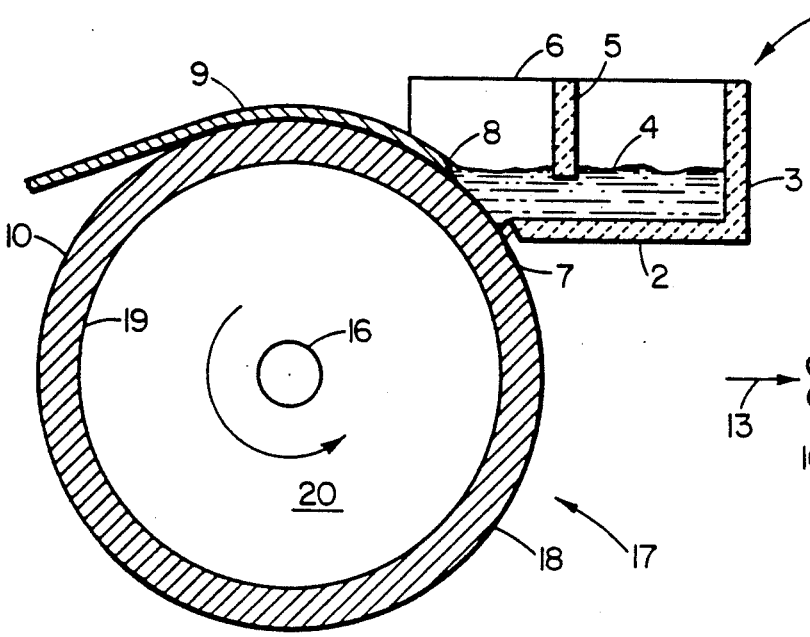
FIGS. 1 and 2 show a cross-sectional, side elevation view and a top view of existing apparatus for melt drag or open tundish casting of metal sheet.
Figure 2:
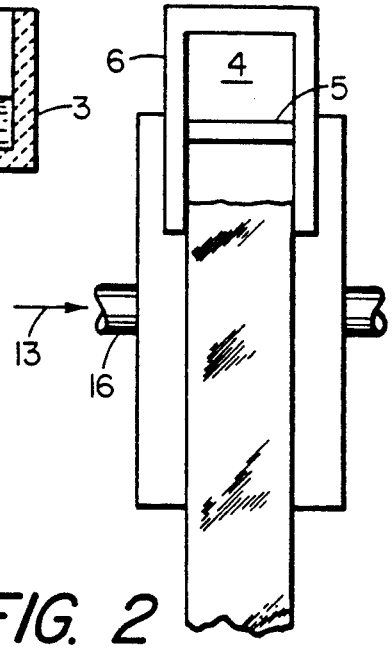

There are several processes for introducing a layer of melt onto a chill substrate to make strip. One method, known as the melt drag, open-tundish process, is shown in FIG. 1 and FIG. 2. A cylindrical substrate 17 is made up of a cylindrical core body 20 surrounded by an annular shell 18. The shell has an outer cylindrical casting surface 10 and an inner cylindrical surface 19 in contact with the core. The substrate 17 is rotated about an axle 16 while the casting surface 10 passes through a pool of molten metal 4 in an open tundish 1.

Figure 6:
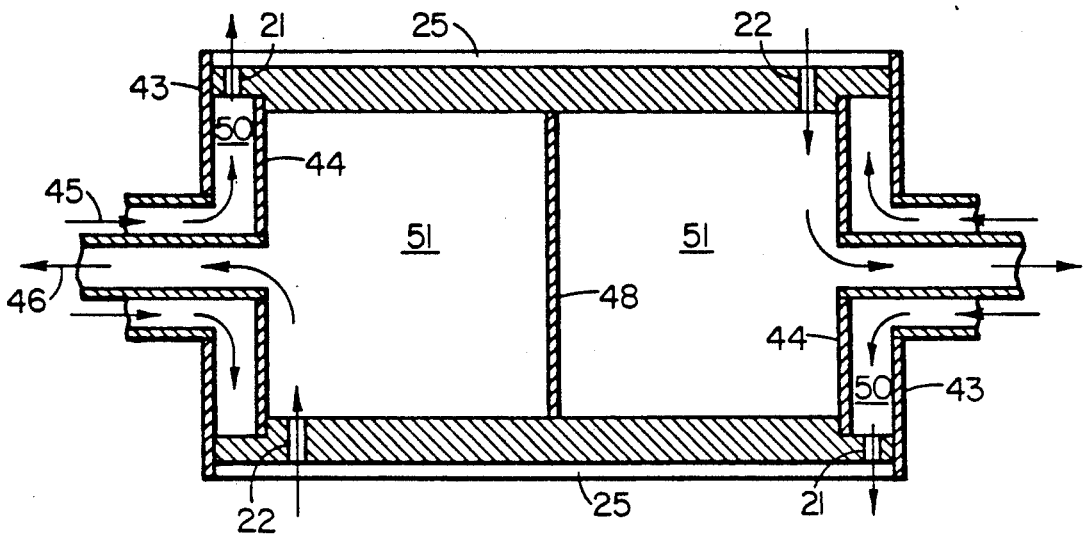
FIG. 6 is a section view along line B—B in FIG. 3 showing the inlet and outlet arrangement to feed the coolant channels.

The open tundish 1 has a bottom 2, backwall 3 and sidewalls 6. The front surface 7 of the bottom and sidewalls adjacent the casting surface 10 are contoured to match the shape of the casting surface. A weir 5 can be used to help control the metal depth and turbulence. As the casting surface passes through the melt pool, a liquid layer 8 is delivered to the surface 10 where it solidifies to strip 9. The thickness depends on several parameters including the depth of the melt pool and the temperature of the casting surface. The casting surface is cooled by circulation of a coolant through cooling channels in the substrate. The coolant typically enters and exits at 13 through connections in the axle (to be further described in connection with FIG. 6). Water is the preferred coolant.

It has been discovered that extreme uniformity of surface temperatures (on the order of ±3° C.) is required to obtain uniform heat transfer, stable casting mechanics, uniform metal strip thickness and to prevent distortion of the wheel. Especially when top rolling the product strip, the thickness of the product is adversely affected by wheel distortion. As shown in FIGS. 3 to 6, uniformity of temperature is accomplished according to the invention by a system of cooling channels wherein the channels are wrapped helically around the drum and the inlets and outlets are not located under the strip casting region as with prior designs. We have termed this a Threaded Coolant Flow (TCF) design.

Figure 3:
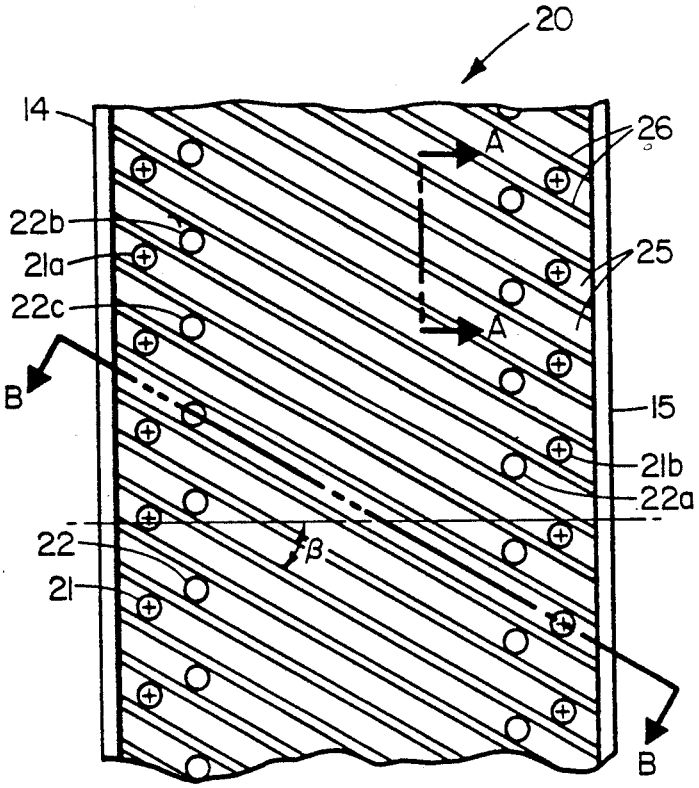
FIG. 3 is a plan view of a cylindrical core body used in the inventive liquid-cooled substrate.

In the embodiment of FIG. 3, the hollow core 20 is shown with parallel cooling channels 25 machined angularly across the core outside surface leaving ribs 26 between channels. The layout shown in FIG. 3 could be used in practice, but is generally fore-shortened to show the concept. In most commercial applications, the core is much longer so that the channels are more helically wrapped around the core.

End plates 14 close off the channels at the periphery of the core. The channels are cut at an angle, $\beta$, of between about 15° and 75° (and preferably between about 45° and 75°) to the drum axis. Each coolant channel 25 has a coolant inlet 21*a* or 21*b* at one end near one side of the substrate and a coolant outlet 22*a* or 22*b* at the other end near the other side of the substrate.

Though we try to limit the temperature difference, coolant entering the coolant channel is cooler than that exiting the outlet. We prefer to limit $\Delta T$ about 6° C. Alternating the inlets and outlets of adjacent channels provides a uniform pattern of cooling with low distortion and very uniform cast products. For example, as shown in FIG. 3, inlet 21*a* is adjacent outlets 22*b* and 22*c* of adjacent channels.

FIG. 3 shows the embodiment wherein the flow in adjacent channels is in opposite directions. The same basic design can be used when the flow in all the channels is in the same direction. Naturally, all the inlets will be on one side and all the outlets on the other side. The advantage of the opposite flow is the pairing of a warmer outlet region with a cooler inlet region. However, if the shell expands during use, some coolant may leak to the adjacent channel and return to the side from which it came. This short circuit can lead to hot spots near the center of the drum surface. With all the flow in adjacent channels in the same direction, the inlet side coolant is a few degrees cooler than the outlet side, but the short circuit phenomenon is avoided. The advantage of flow in the same direction is therefore the elimination of potential hot spots when a particular use results in shell expansion and short circuiting of coolant. The selection of flow in the same direction or in opposite direction will depend on the application.

Uniform temperature depends on controlling the heat transfer coefficient, which depends (among other things) on the coolant velocity. The velocity can be altered be the varying the size and length of the channels. But there are constraints on the size of the channels, like the structural integrity of the casting wheel. So, the coolant velocity is more easily controlled by the length of the channels. The length of the channels (and therefore the number of channels necessary to cover the surface) are chosen to produce the desired cooling effect.

The angular configuration of the channels involves a trade off affecting the heat transfer efficiency. Wrapping of long channels across the surface (large $\beta$) results in fewer channels, higher velocity of coolant (for a given flow rate), and higher heat transfer. But a longer channel has a higher pressure drop between the inlet and outlet of the channel which may contribute to the short circuit phenomenon when the outside shell 18 expands away from the ribs 26 during operation. The coolant in a channel may cross over the rib and return to the outlet of the adjacent channel on the side of the substrate from which it came rather than flow down the channel to its own outlet on the other side of the substrate. This, of course, is undesirable and causes hot spots. The angle $\beta$ is therefore chosen by determining the heat load and designing the channel angle to maximize heat transfer while minimizing short circuiting at the available flow rate.

The number of channels, N, around the casting drum is related to the angle, $\beta$, between the channel and the plane perpendicular to the drum axis, by the relationship $$N = L\sin\beta / P\Psi \quad (1)$$

where L is the drum axial length, P is the center to center distance between channels measured perpendicular to the channel, and $\Psi$ is the fraction of a revolution traversed by each channel around the drum. $\Psi$ is related to $\beta$ by $$\Psi = T\mathrm{Tan}\,\beta / C \quad (2)$$

where C is the drum circumference.

The preferred design for the inventive chill wheel has $\Psi = 1$, meaning that the channels each make one revolution of the wheel. The advantage of such design is that the heat load is identical for all channels at all times.

Axial channels or other channels not making a complete revolution, are exposed to different heat loads depending on their position relative to the metal strip. In the former designs, the channels are loaded equally on a time-averaged basis, but not instantaneously. Since heat causes changes in the physical properties of the coolant, unbalanced heat load can cause unbalanced flow in the wheel, possibly leading to flow instability and/or local hot spots. Other designs where each channel makes a higher integer number of revolutions would also benefit from the even heat load condition, but machining limitations and coolant velocity and pressure become considerations for long channels.

As an example, with P=2.54 cm, a 107 cm wide by 71 cm diameter drum preferably is constructed with 38 channels. Each channel makes 0.997 revolutions and is 247 cm long.

Figure 4:
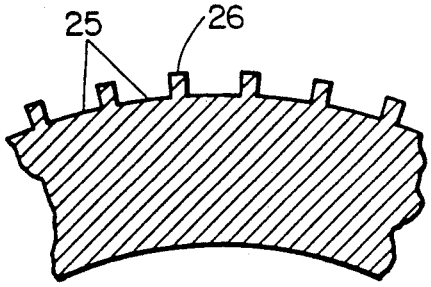
FIG. 4 is an expanded section view of the coolant channels along line A—A in FIG. 3.

FIG. 4 shows an enlarged section view of the inventive Threaded Coolant Flow substrate core. The channels 25 are machined in the surface leaving the ribs 26 between channels.

Figure 5:
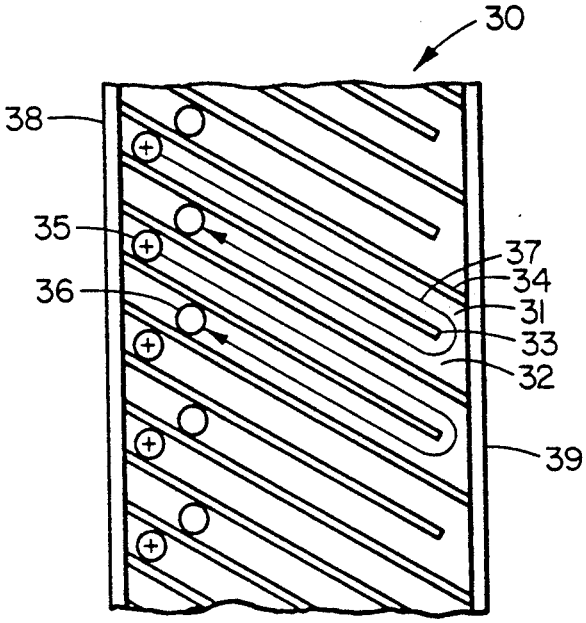
FIG. 5 is a plan view showing an alternative embodiment of the coolant channel configuration according to the invention.

FIG. 5 shows an alternative embodiment of the invention which allows all the coolant supply apparatus to be located on one side of the substrate. The cylindrical core 30 has coolant channel pairs machined into the surface extending in a first channel 31 across the substrate from near one side 38 of the substrate to near the other side 39 of the substrate and a second channel 32 back to near the first side 38. The paired first and second channels are in liquid communication near the other side 39. For example, the channel pairs may be separated by a shortened rib 33 whereas the pairs are separated from the next pair by the full width ribs 34. The channels are again substantially parallel to each other channel and cut at an angle, $\beta$, of greater than about 15° to the core axis. Each coolant channel pair communicates with an inlet 35 in the first channel near the one side 38 of the casting surface and an outlet 36 in the second channel near the same one side 38 of the casting surface. The direction of coolant flow is shown by arrow 37 from the inlet to the outlet. The inlets and outlets are again alternated around the circumference so that the flow across the substrate in each coolant channel leg is opposite the direction of coolant flow in each adjacent coolant channel leg.

The inlets and outlets communicate in any conventional manner with a source of coolant and a coolant dump through supply and return passages drilled in the core. In one embodiment shown in FIG. 6, which is a section from FIG. 3, coolant supply reservoirs 50 are defined by end caps 43 and 44 on each end of the hollow core 20. Coolant is supplied as at 45 through an axial conduit to the supply reservoir. Coolant from the supply reservoir flows through inlets 21, through the coolant channels 25 on the substrate surface and then leaves through outlets 22. It then passes into a coolant dump 51 on the side opposite the supply reservoir. The dumps are formed between end caps 44 and a central divider 48 inside the drum. Coolant then leaves the dumps as at 46. Similar supply and dumps are located on each side since inlets and outlets are on both sides. For the embodiment in FIG. 5, supply and return apparatus is similar in nature but, of course, is limited to one side of the substrate. For the embodiment having all the inlets on one side of the drum and all the outlets on the other side, a simpler design with a supply reservoir on the one side and the dump on the other side is used.

A slight throttling of the coolant may be useful for mitigating cavitation by the intimate contact of the coolant with the shell. This can be accomplished, for example, by a slight choking of the outlets (e.g. by making the outlets slightly smaller than the inlets) or by the use of a downstream flow-control valve.

The coolant channels are machined below the casting surface by any known means. It is convenient to have a core body covered with an annular shell. This allows the shell to be removed and replaced by another new casting surface without replacing the core. If the coolant channels are grooves machined in the core, the replacement of the shell saves labor in making new coolant channels. Of course, the grooves could be machined in the inside surface of the shell or both in the shell and the core body.

EXAMPLE

The casting wheel is essentially a heat transfer medium. It absorbs the thermal energy released when the molten metal solidifies to form the strip. It then transfers this thermal energy to the coolant. Not only must the casting wheel be capable of transferring large amount of thermal energy, it must also transfer the heat uniformly with respect to both time and distance. The heat transferred after 100 hours of operation must be the same as after 1 hour of operation for the process to be continuous. And the heat transferred across the casting track width and around the casting wheel circumference must remain stable to achieve a rollable strip profile.

Casting 1 mm-thick aluminum strip at 60 m/min on a chill wheel generates approximately 1000 BTUs/-min/cm of cast width. If 75 cm-wide strip is cast with 125 liters/sec of water as coolant, the coolant temperature will rise less than 4° C. These coolant flow and coolant temperature rise conditions are sufficient to avoid boiling of the coolant along the coolant/shell interface which has been found to reduce heat transfer.

Even though the coolant temperature may rise as little as 4°C., the caster shell temperature may increase hundreds of degrees during casting. Nonuniform heat transfer may yield nonuniform caster shell temperatures which induce elastic distortion in the caster shell. The level of distortion is therefore an indirect measure of the uniformity of heat transfer from the caster shell to the coolant.

Several coolant channel configurations have been examined to try to make the heat transfer more uniform. One conventional design, the so-called "Hunter" wheel (which we call CCF), has coolant channels running circumferentially around the wheel and may have several inlets and outlets for each channel under the casting surface. For ease of fabrication, the inlets of adjacent channels are axially adjacent the inlets of all other channels. Likewise for the outlets. And since the coolant entering the channel is cooler than the coolant leaving the channel, and since incoming coolant impinges directly upon the underside of the casting surface, this arrangement results in a cool region followed by a relatively hot region, followed by a relatively cool region, and so on as one proceeds around the circumference.

A Staggered Coolant Flow or SCF design is shown in U.S. Pat. No. 4,842,040 wherein the inlets in the CCF design are offset from the inlets of adjacent channels by a certain angular distance so that a relative cool inlet is more closely associated with a relatively warmer outlet of adjacent channels than another cooler inlet. This configuration reduces, but does not eliminate the effect of having the inlet and outlet plenums beneath the casting track.

In both the former CCF and SCF designs, the coolant enters the wheel along the centerline axis and goes through an internal distribution system into inlet holes which deliver the coolant to channels arranged around the core circumference. The channels are separated by lands onto which the caster shell is fit. After traveling through the channels and absorbing heat, the water flows down outlet holes into the core interior and exits the core along its centerline axis. In this design of circumferential channels, the inlets and outlets must be under the casting surface. In the Threaded Coolant Flow design of the present invention, wherein the channels are not laid circumferentially, the inlets and outlets are preferably placed outside of the casting surface.

The three designs were utilized in a 25 cm wide laboratory casting machine casting aluminum strip on a grooved steel shell with a steel core. Using similar typical casting conditions, the CCF design resulted in distortion of the casting shell with a valley (i.e., an axial low region) over each row of coolant inlets and a hill (i.e., an axial high region) over each row of coolant outlets. The difference in radius between the high and low points along the circumference is shown in Table 1.

TABLE 1

| Linear Voltage Differential Transducer Measurements of Distortion | |
|---|---|
| Core Design | Centerline Distortion |
| Hunter Type (CCF) | 0.18 mm |
| Staggered Flow (SCF) | 0.09 mm |
| Threaded Flow (TCF) | 0.05 mm |

The SCF wheel showed less distortion because of the circumferential offset in inlets and outlets, but a 0.09 mm variation on this laboratory wheel is magnified on a production wheel and will still result in a product which is commercially unacceptable for rolling in most applications. Moreover, such distortion produces a cyclic change in the separation between the casting surface and the tundish which also negatively affects strip casting behavior and quality.

The inventive TCF wheel resulted in a distortion of only about 0.05 mm in the same trial. The design has reduced distortion considerably and also improved the uniformity of heat transfer, resulting in lower thickness variations which can be correlated with core design. Tests on a 100 cm wide caster in a pilot plant environment have shown relatively similar improvements in casting behavior and strip quality with the TCF design, and reduced caster shell distortion.

We claim:

1. A uniformly-cooled substrate for casting uniform metal products directly from a metal melt comprising a cylindrical, casting drum having an outer cylindrical, heat-conductive casting surface and a plurality of coolant channels below and in heat transfer relationship with the casting surface and being substantially parallel to each other at an angle between about 15° and 75° to the drum axis, and means for circulating a coolant liquid through the coolant channels.

2. The uniformly-cooled substrate for casting uniform metal products directly from the metal melt as in claim 1 wherein the coolant channels make an angle of at least about 45° to the drum axis.

3. The uniformly-cooled substrate for casting uniform metal products directly from the metal melt as in claim 2 wherein each coolant channel makes about one revolution of the casting drum.

4. The uniformly-cooled substrate for casting uniform metal products directly from the metal melt as in claim 1 wherein the means for circulating a coolant liquid through the coolant channels includes means for circulating the coolant liquid in the same direction in adjacent channels.

5. The uniformly-cooled substrate for casting uniform metal products directly from the metal melt as in claim 4 wherein the means for circulating a coolant liquid through the coolant channels in the same direction comprises a coolant inlet in each coolant channel near one side of the casting surface and a coolant outlet near the other side of the casting surface.

6. The uniformly-cooled substrate for casting uniform metal products directly from the metal melt as in claim 5 wherein the casting drum comprises a cylindrical core having multiple coolant inlets and outlets in an outer cylindrical surface thereof, and an annular, heat-conductive casting shell having inside and outside cylindrical surfaces, the outside surface comprising the heat-conductive casting surface and the inside surface overlaying the core outer cylindrical surface and cooperating therewith to define the plurality of coolant channels extending across the casting surface.

7. The uniformly-cooled substrate for casting uniform metal products directly from the metal melt as in claim 6 wherein the coolant channels comprise machined grooves in the casting shell enclosed by the outer surface of the core.

8. The uniformly-cooled substrate for casting uniform metal products directly from the metal melt as in claim 6 wherein the coolant channels comprise machined grooves in the outer surface of the core enclosed by the inside surface of the casting shell.

9. The uniformly-cooled substrate for casting uniform metal products directly from the metal melt as in claim 6 which further includes supply passages communicating the inlets with a coolant source and return passages communicating the outlets with a coolant dump.

10. The uniformly-cooled substrate for casting uniform metal products directly from the metal melt as in claim 9 wherein the core additionally comprises an axle for rotation of the substrate and wherein the coolant source and coolant dump are reservoirs located around the axle on each side of the core.

11. The uniformly-cooled substrate for casting uniform metal products directly from the metal melt as in claim 1 wherein the means for circulating a coolant liquid through the coolant channels includes means for circulating the coolant liquid in opposite directions in adjacent channels.

12. The uniformly-cooled substrate for casting uniform metal products directly from the metal melt as in claim 11 wherein the means for circulating a coolant liquid through the coolant channels in opposite directions comprises a coolant inlet in each coolant channel near one side of the casting surface and a coolant outlet near the other side of the casting surface.

13. The uniformly-cooled substrate for casting uniform metal products directly from the metal melt as in claim 11 wherein the means for circulating a coolant liquid through first and second adjacent coolant channels in the opposite directions comprises a coolant inlet in the first coolant channel near one side of the casting surface and a coolant outlet in the second coolant channel near the same side of the casting surface, and means for joining the first and second coolant channels in liquid communication on the other side of the casting surface.

14. The uniformly-cooled substrate for casting uniform metal products directly from the metal melt as in claim 13 wherein the coolant channels make an angle of at least about 45° to the drum axis.

15. The uniformly-cooled substrate for casting uniform metal products directly from the metal melt as in claim 13 wherein the casting drum comprises a cylindrical core having multiple coolant inlets and outlets in an outer cylindrical surface thereof, and an annular, heat-conductive casting shell having inside and outside cylindrical surfaces, the outside surface comprising the heat-conductive casting surface and the inside surface overlaying the core outer cylindrical surface and cooperating therewith to define the plurality of adjacent coolant channels extending across the casting surface.

16. The uniformly-cooled substrate for casting uniform metal products directly from the metal melt as in claim 15 wherein the coolant channels comprise machined grooves in the casting shell enclosed by the outer surface of the core.

17. The uniformly-cooled substrate for casting uniform metal products directly from the metal melt as in claim 15 wherein the coolant channels comprise machined grooves in the outer surface of the core enclosed by the inside surface of the casting shell.

18. The uniformly-cooled substrate for casting uniform metal products directly from the metal melt as in claim 15 which further includes supply passages communicating the inlets with a coolant source and return passages communicating the outlets with a coolant dump.

19. The uniformly-cooled substrate for casting uniform metal products directly from the metal melt as in claim 18 wherein the core additionally comprises an axle for rotation of the substrate and wherein the coolant source and coolant dump are reservoirs located around the axle on same side of the core.

20. A process for casting uniform metal products directly from a metal melt by extracting a molten metal layer from an open tundish on an outer cylindrical casting surface of a cylindrical substrate and solidifying the molten metal layer to a solid strip wherein the improvement comprises circulating a coolant liquid through a plurality of adjacent coolant channels extending under the casting surface substantially parallel to each other at an angle of between abut 15° and 75° to the drum axis.

21. The process for casting uniform metal products directly from a metal melt as in claim 20 which further includes circulating the coolant liquid through adjacent channels in the same direction.

22. The process for casting uniform metal products directly from a metal melt as in claim 20 which further includes circulating the coolant liquid through adjacent channels in opposite directions.

23. The process for casting uniform metal products directly from a metal melt as in claim 22 which further includes joining first and second adjacent coolant channels in liquid communication near one side of the casting surface, and circulating the coolant liquid in through a coolant inlet in the first coolant channel near the other side of the casting surface and out through a coolant outlet in the second coolant channel near the same other side of the casting surface.

* * * * *